US009514870B2

(12) United States Patent
Kaneko et al.

(10) Patent No.: US 9,514,870 B2
(45) Date of Patent: Dec. 6, 2016

(54) RARE EARTH MAGNET AND METHOD FOR PRODUCING THE SAME

(75) Inventors: Yuji Kaneko, Nagoya (JP); Hisaaki Takao, Seto (JP); Yukio Takada, Nisshin (JP); Motoki Hiraoka, Toyota (JP); Keiu Kanada, Miyoshi (JP)

(73) Assignees: KABUSHIKI KAISHA TOYOTA CHUO KENKYUSHO, Nagakute-shi (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 368 days.

(21) Appl. No.: 13/978,788

(22) PCT Filed: Feb. 13, 2012

(86) PCT No.: PCT/JP2012/053270
§ 371 (c)(1),
(2), (4) Date: Jul. 9, 2013

(87) PCT Pub. No.: WO2012/111611
PCT Pub. Date: Aug. 23, 2012

(65) Prior Publication Data

US 2013/0315775 A1 Nov. 28, 2013

(30) Foreign Application Priority Data

Feb. 15, 2011 (JP) ..... 2011-029445

(51) Int. Cl.

| | |
|---|---|
| ***C23C 10/28*** | (2006.01) |
| ***C23C 10/06*** | (2006.01) |
| ***H01F 1/08*** | (2006.01) |
| ***H01F 41/02*** | (2006.01) |
| ***C22C 38/00*** | (2006.01) |
| ***C22C 38/10*** | (2006.01) |
| ***C22C 38/16*** | (2006.01) |
| ***C22C 1/00*** | (2006.01) |
| ***B22F 3/10*** | (2006.01) |
| ***H01F 41/00*** | (2006.01) |
| ***B22F 3/24*** | (2006.01) |
| ***C22C 1/02*** | (2006.01) |
| *H01F 1/057* | (2006.01) |

(52) U.S. Cl.

CPC ..... *H01F 1/086* (2013.01); *B22F 3/1007* (2013.01); *B22F 3/24* (2013.01); *C22C 1/00* (2013.01); *C22C 1/02* (2013.01); *C22C 38/002* (2013.01); *C22C 38/005* (2013.01); *C22C 38/10* (2013.01); *C22C 38/16* (2013.01); *H01F 41/005* (2013.01); *H01F 41/0266* (2013.01); *H01F 41/0293* (2013.01); *B22F 2003/241* (2013.01); *B22F 2203/11* (2013.01); *B22F 2207/01* (2013.01); *C22C 2202/02* (2013.01); *H01F 1/0577* (2013.01)

(58) Field of Classification Search

CPC ..... C22C 38/005; H01F 1/086; H01F 1/0536; H01F 41/0293; B22F 3/006; B22F 3/1007; H01H 41/0266; C23C 10/00–10/60

See application file for complete search history.

(56) References Cited

U.S. PATENT DOCUMENTS

| | | | | |
|---|---|---|---|---|
| 2010/0037826 | A1 | 2/2010 | Nagata et al. | |
| 2011/0001593 | A1* | 1/2011 | Nagata | H01F 41/026 335/302 |
| 2011/0012699 | A1* | 1/2011 | Odaka | C21D 6/00 335/302 |
| 2011/0052799 | A1* | 3/2011 | Nagata | B22F 3/24 427/127 |

FOREIGN PATENT DOCUMENTS

| | | |
|---|---|---|
| JP | A-2008-177332 | 7/2008 |
| JP | A-2009-43776 | 2/2009 |
| JP | A-2009-200179 | 9/2009 |
| WO | WO 2006/100968 A1 | 9/2006 |
| WO | WO 2007/102391 A1 | 9/2007 |
| WO | WO 2008/032666 A1 | 3/2008 |
| WO | WO 2009/016815 A1 | 2/2009 |

OTHER PUBLICATIONS

Japanese Office Action issued in Japanese Patent Application No. 2011-029445 on May 22, 2012 (with translation).
Japanese Office Action issued in Japanese Patent Application No. 2011-029445 on Jan. 22, 2013 (with translation).
International Search Report issued in International Application No. PCT/JP2012/053270 on May 15, 2012 (with translation).

* cited by examiner

*Primary Examiner* — Jessee Roe
*Assistant Examiner* — Jeremy Jones
(74) *Attorney, Agent, or Firm* — Oliff PLC

(57) ABSTRACT

A rare earth magnet production method of the present invention includes a placing step of placing a magnet material including a compact or a sintered body of powder particles having a rare earth magnet alloy, and a diffusing material containing a diffusing element to improve coercivity, in a vicinity of each other; and a diffusing step of diffusing the diffusing element into an inside of the magnet material by exposing the magnet material heated to vapor of the diffusing element evaporated from the diffusing material heated; and wherein the diffusing step is a step of heating the diffusing material independently of the magnet material to diffusing material temperature which is different from heating temperature of the magnet material called magnet material temperature.

6 Claims, 1 Drawing Sheet

RARE EARTH MAGNET AND METHOD FOR PRODUCING THE SAME

TECHNICAL FIELD

The present invention relates to a rare earth magnet (especially an anisotropic rare earth magnet) having good magnetic properties (especially coercivity) and a method for producing the same.

BACKGROUND ART

Rare earth magnets (especially permanent magnets) typically exemplified by Nd—Fe—B based magnets exhibit very high magnetic properties. Since use of the rare earth magnets can realize downsizing, output power enhancement, density enhancement, environmental burden reduction and the like of electromagnetic devices and electric motors, application of the rare earth magnets is being investigated in a wide range of fields.

However, in order to achieve practical application, it is requested that good magnetic properties of the rare earth magnets are exhibited stably for a long time even under severe environments. Therefore, research and development are actively conducted to improve coercivity, which is effective in providing heat resistance (demagnetization resistance), while maintaining or improving high residual magnetic flux density of the rare earth magnets. One of the most effective methods is to diffuse a diffusing element such as dysprosium (Dy) and terbium (Tb), which is a rare earth element having high anisotropic magnetic field (Ha), into grain boundaries of main phase crystal (e.g., $Nd_2Fe_{14}B$-type crystal) and the like. This diffusion treatment allows an improvement in crystal magnetic anisotropy and suppression of generation of starting points of reverse magnetic domains while suppressing replacement of Dy or the like in crystal grains, and accordingly allows an improvement in coercivity while suppressing a decrease in residual magnetic flux density.

By the way, this diffusion treatment can be performed in a variety of methods. One example of the methods is a powder mixing method in which magnet powder comprising a raw material alloy of a rare earth magnet (hereinafter referred to as a "rare earth magnet alloy") is mixed with diffusing powder containing a diffusing element and a compact of the obtained mixed powder is sintered or the like to perform the aforementioned diffusion treatment. Another example of the methods is a coating method in which diffusing powder or the like is coated on a surface of a magnet material to be subjected to diffusion treatment and then heat treatment is applied to the coated material to perform the diffusion treatment. Furthermore, in order to perform efficient diffusion treatment while suppressing the amount of Dy, or the like, which is a scarce element, to be used, a vapor method has recently been proposed in which a diffusing element is efficiently diffused into an inside of a magnet material by exposing the magnet material to vapor of the diffusing element. Description of this vapor method is found, for example, in the following patent documents.

CITATION LIST

Patent Literature

[PTL 1] International Publication No. WO 2006/100968

[PTL 2] International Publication No. WO 2007/102391 (Japanese Unexamined Patent Publication Nos. 2008-263223 and 2009-124150)

[PTL 3] Japanese Unexamined Patent Publication No. 2008-177332

[PTL 4] Japanese Unexamined Patent Publication No. 2009-43776

SUMMARY OF INVENTION

Technical Problem

Subject Matters described in all the aforementioned patent literature are basically to perform diffusion treatments by heating a diffusing material serving as a source of vapor of a diffusing element and a magnet material to be subjected to diffusion treatment under the same conditions, and efficiency of these diffusion treatments is not always high.

The present invention has been made in view of these circumstances. That is to say, it is an object of the present invention to provide a rare earth magnet production method capable of obtaining a rare earth magnet having higher magnetic properties at lower costs by performing efficient and effective diffusion treatment while suppressing the amount of a scarce diffusing element such as Dy to be used, unlike in conventional vapor methods, and also provides such a rare earth magnet having high magnetic properties.

Solution to Problem

The present inventors have earnestly studied and made trial and error in order to solve the problem. As a result, the present inventors have newly found that when diffusion treatment is performed by the vapor method, magnetic properties (especially coercivity) of a rare earth magnet can be effectively and efficiently improved while suppressing the amount of a scarce diffusing element by individually controlling heating temperature of a magnetic material and a diffusing material. The present inventors have developed this fruit and completed the present invention as described below.

Method for Producing Rare Earth Magnet (1) That is to say, a method for producing a rare earth magnet according to the present invention comprises a placing step of placing a magnet material including a compact or a sintered body of powder particles having a rare earth magnet alloy, and a diffusing material containing a diffusing element to improve coercivity, in a vicinity of each other; and a diffusing step of diffusing the diffusing element into an inside of the magnet material by exposing the magnet material heated to vapor of the diffusing element evaporated from the diffusing material heated; and wherein the diffusing step is a step of heating the diffusing material independently of the magnet material to diffusing material temperature (Td) which is different from heating temperature of the magnet material called magnet material temperature (Tm).

(2) The amount of vapor of a diffusing element largely depends on temperature of a diffusing material (a diffusing material temperature). On the other hand, diffusion speed of the diffusing element inside a magnet material (especially crystal grain boundaries) largely depends on temperature of the magnet material (magnet material temperature). In the diffusing step of the present invention, the diffusing material temperature and the magnet material temperature are separately controlled so as to ensure consistency or cooperation of the diffusion speed inside the magnet material and the amount of vapor of the diffusing element. As a result, for example, it is possible to suppress the diffusing element from being deposited in an extra amount or concentrated excessively in a vicinity of a surface layer of the magnet material due to an excessively large amount of vapor of the diffusing element relative to diffusion speed inside the magnet material. On the other hand, it is also possible to avoid an increase in diffusion treatment time due to an excessively small amount of vapor of the diffusing element relative to diffusion speed inside the magnet material.

According to the method for producing a rare earth magnet of the present invention, the diffusing element can thus be sufficiently diffused into an inside of the magnet material in a shorter time without wasting the scarce diffusing element, so efficient and effective diffusion treatment can be performed and a rare earth magnet having higher magnetic properties can be obtained at lower costs.

(3) By the way, in addition to the aforementioned method, efficient and effective diffusion treatment can also be performed by the following method. That is to say, the present invention can be a method for producing a rare earth magnet, comprising a placing step of placing a magnet material including a compact of powder particles having a rare earth magnet alloy, and a diffusing material containing a diffusing element to improve coercivity, in a vicinity of each other; and a diffusing step of diffusing the diffusing element, into an inside of the magnet material by exposing the magnet material heated to vapor of the diffusing element evaporated from the diffusing material heated; and wherein the diffusing step is performed during a temperature rising stage or a cooling stage of a sintering step of heating the compact into a sintered body.

Diffusion speed inside the magnet material can vary even during stages of raising, maintaining and lowering temperature of a compact to form a sintered body. Especially diffusion speed of the diffusing element increases upon generation of liquid phase inside the magnet material (a compact or a sintered body) and the diffusion speed also increases as the magnet material temperature rises. Thus, diffusion treatment by the vapor method can be efficiently performed by simultaneously performing a diffusing step with a predetermined region of a sintering step in which diffusion speed is high.

However, it is assumed that if the diffusing material temperature is excessively high (for example, a sintering temperature above 1100 deg. C.), the amount of vapor of the diffusing element becomes excessively large, and an excess of the diffusing element may be deposited on a surface of the magnet material or excessively concentrated. If the diffusing step is simultaneously performed during the temperature rising stage or cooling stage of the sintering step as mentioned above, such inconveniences do not occur and efficient and effective diffusion treatment can be performed while effectively using the scarce diffusing element.

Device for Producing a Rare Earth Magnet (1) The present invention can be grasped not only as the aforementioned production method but also as a rare earth magnet production device suitable for the method. That is to say, the present invention can be grasped as a device for producing a rare earth magnet which is characterized by comprising: a treatment chamber for performing diffusion treatment or sintering, gas pressure control means for controlling gas pressure in the treatment chamber; placing means for placing a magnet material comprising a compact or a sintered body of powder particles comprising a rare earth magnet alloy, and a diffusing material containing a diffusing element to improve coercivity, in a vicinity of each other in the treatment chamber; magnet material heating means for heating the magnet material; diffusing material heating means for heating the diffusing material; magnet material temperature control means for controlling magnet material temperature (Tm) which is heating temperature of the magnet material heated by the magnet material heating means; and diffusing material temperature control means for controlling diffusing material temperature (Td) which is heating temperature of the diffusing material heated by the diffusing material heating means; and by being capable of diffusing the diffusing element into an inside of the magnet material by exposing the magnet material heated to vapor of the diffusing element evaporated from the diffusing material heated.

(2) It is preferred that this device for producing a rare earth magnet further comprises a preparatory chamber communicating with the treatment chamber and capable of storing the diffusing material heating means; stopping means capable of arbitrarily stopping communication between the treatment chamber and the preparatory chamber; and transfer ring means for transferring the diffusing material heating means between the preliminary chamber and the treatment chamber.

Rare Earth Magnet

The present invention can be grasped not only as the aforementioned production method but also as a rare earth magnet obtained by the production method. This "rare earth magnet" includes rare earth magnet raw materials and rare earth magnet members and is not limited in shape. For example, the rare earth magnet can be shaped of a block, a ring or a thin film. Relating to those having high magnetic properties, the rare earth magnet of the present invention is basically an anisotropic rare earth magnet, but can be an isotropic rare earth magnet.

Note that the magnet material is a material to be subjected to diffusion treatment, and can be a compact comprising a rare earth magnet alloy or a sintered body obtained by sintering the compact. The magnet material can be a processed body having a final product shape or a shape close to the final product shape, or a bulk material before processing.

In the rare earth magnet of the present invention, the diffusing element has diffused into grain boundaries within an inside of the rare earth magnet owing to the aforementioned diffusion treatment, but the degree of diffusion is not limited. It should be noted that though it is more moderate than in a conventional rare earth magnet, a concentration gradient of the diffusing element can occur from a surface layer portion to an inside of the magnet, and diffusing element-rich portions can be generated in the surface layer portion. Moreover, the diffusing element can not only undergo surface diffusion or grain boundary diffusion in which the diffusing element diffuses into boundaries or grain boundaries of powder particles or crystal grains but also undergo lattice diffusion in which the diffusing element diffuses into an inside of crystal grains, although the amount is small. It should be noted that when simply referred to as "grain boundaries" or "boundaries" in the description of the present invention, it can include "grain boundaries" or "boundaries" of not only powder particles but also crystal grains constituting the powder particles.

Others (1) The rare earth element (R) mentioned herein includes scandium (Sc), yttrium (Y), and lanthanoid. Lanthanoid includes lanthanum (La), cerium (Ce), praseodymium (Pr), neodymium (Md), samarium (Sm), europium (Eu), gadolinium (GO), terbium (Tb), dysprosium (Dy), holmium (Ho), erbium (Er), thulium (Tm), ytterbium (Yb), lutetium (Lu).

(2) The rare earth magnet alloy mentioned herein comprises a main rare earth element (hereinafter referred to as "Rm") which is at least one of rare earth elements, boron (B), the remainder being a transitional metal element (TM; mainly Fe), and inevitable impurities with or without a reforming element. This "Rm" comprises at least one of the aforementioned R, and especially Nd and/or Pr are typically employed as "Rm".

The reforming element is at least one of cobalt (Co) and lanthanum (La), which improve heat resistance of the rare earth magnet material, and gallium (Ga), niobium (Nb), aluminum (Al), silicon (Si), titanium (Ti), vanadium (V), chromium (Cr), manganese (Mn), nickel (Ni), copper (Cu), germanium (Ge), zirconium (Zr), molybdenum (Mo), indium (In), tin (Sn), hafnium (Hf), tantalum (Ta), tungsten (W) and lead (Pb), which are effective in improving magnetic properties such as coercivity. These reforming elements can be combined arbitrarily. Content of the reforming element is generally very small and, for example, it is preferred that the content is about 0.01 to 10 % by mass.

The inevitable impurities are impurities which are contained originally in the rare earth magnet alloy or mixed in each step, and which are difficult to be removed for cost or technical reasons. Examples of such inevitable impurities include oxygen (O), nitrogen (N), carbon (C), hydrogen (H), calcium (Ca), sodium (Ma), potassium (K), and argon (Ar).

It should be noted that the reforming element can not only be contained in powder particles but also be diffused into the magnet material by a variety of methods. Moreover, when the reforming element is an alloy having a low melting point, for example, the reforming element can be diffused in a temperature rising stage of a sintering step (for example, from 300 to 1100 deg. C.). The aforementioned discussion about the reforming element and inevitable impurities appropriately applies to the diffusing material which serves as a supply source of the diffusing element.

(3) The diffusing material is not limited in composition, kind or shape, but is suitable for diffusion treatment by a vapor method and contains a diffusing element (an element to improve coercivity). Typical examples of the diffusing element include a diffusing rare earth element (Rd) such as Dy, Tb and Ho. It is preferred that the diffusing material comprises a single substance or an alloy of these elements. It should be noted that the diffusing material used in the diffusion step can be of one kind or a plurality of kinds.

(4) A range "x to y" as used herein includes a lower limit value x and an upper limit value y, unless otherwise specified, Moreover, a range such as "a to b" can be formed by arbitrarily combining various lower limit values and upper limit values recited herein. Furthermore, any given numerical value contained in the ranges recited herein can be used as an upper limit value or a lower limit value for defining a numerical value range.

MODES FOR CARRYING OUT THE INVENTION

Figure 1:
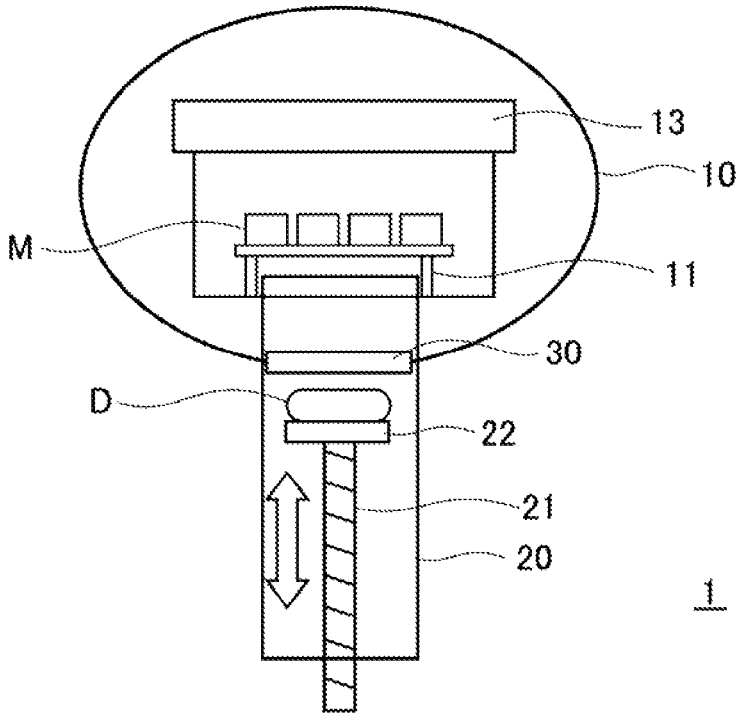
FIG. 1 is a schematic view of a diffusion treatment device.

The present invention will be described in more detail by way of embodiments of the invention. It should be noted that a subject matter discussed in the present description including those of the following embodiments is appropriately applied not only to a production method but also a rare earth magnet according to the present invention. One or more constituent features arbitrarily selected from the constitution described below can be added to the aforementioned constitution of the present invention. Constitution of a production method can be constitution of a rare earth magnet, when if is understood as a product by process. Which embodiment is best varies with target application, required performance and the like.

Production Method

The rare earth magnet production method of the present invention comprises a placing step of placing a magnet material to be treated, and a diffusing material serving as a source of vapor of a diffusing element, in a vicinity of each other, and a diffusing step of performing diffusion treatment by exposing the magnet material to the vapor of the diffusing element. Here, the diffusing step, which is a main characteristic portion of the present invention, will be discussed.

(1) According to the diffusion step of the present invention, diffusing material temperature (Td) which is heating temperature of the diffusing material, can be set and controlled independently of magnet material temperature (Tm) which is heating temperature of the magnet material. This allows the magnet material to be heated to Tm at which liquid phase occurs in boundaries or grain boundaries and diffusion speed is high, while allowing the diffusing material to be heated to Td at which vapor of the diffusing element is generated in an amount suitable for the diffusion speed. As a result, effective diffusion treatment can be achieved in a short time while suppressing the amount of the scarce diffusing element used.

(2) This diffusing step does not have to be performed in a single independent step, and at least part of a sintering step of sintering a compact comprising powder particles can also serve as the diffusing step. In this case, if the diffusing step is performed in a temperature range in which liquid phase occurs in the compact, diffusion speed inside the compact can be high and efficient diffusion treatment can be performed in a short time.

When a compact comprising powder particles of a rare earth magnet alloy is sintered, temperature at which liquid phase occurs in boundaries of a main phase comprising $R_2TM_{14}B_1$ type crystal (TM: a transitional metal element), B-rich phase and R phase is about 600 to 700 deg. C. For example, in a case of an Nd—Fe—B based rare earth magnet alloy, liquid phase starts to occur at 665 deg. C. However, when the compact comprises powder particles of a hydrotreated rare earth magnet alloy, a reaction, $RH_2 \rightarrow R + H_2$ occurs at about 750 to 850 deg. C., which is higher than the aforementioned temperature, and then the aforementioned liquid phase starts to occur. For example, when the compact comprises hydrotreated Nd—Fe—B based powder particles, liquid phase starts to occur at 800 deg. C. Therefore, it is preferred to enhance diffusion speed inside the magnet material by heating the magnet material above such a temperature at which liquid phase starts to occur.

It should be noted that in addition to the above process, liquid phase within the compact also occurs by formation of a eutectic system of the diffusing element and an element in the powder particles. For example, Dy as a diffusing element and Fe in the powder particles start to form liquid phase at a eutectic point of 890 deg. C. The amount of liquid phase in the compact may be increased by formation of such a eutectic system and as a result, diffusion speed within the compact can be further enhanced.

(3) A temperature range at which liquid phase occurs in the compact and diffusion speed sharply increases varies with composition of powder particles and the kind of diffusing element and is difficult to be categorically specified. However, for example, when the magnet material comprises a R-TM-B based rare earth magnet alloy and the diffusing element comprises a diffusing rare earth element (Rd), which is at least one of rare earth elements, it is preferred that magnet material temperature (Tm) is 500 to 1100 deg. C. and diffusing material temperature (Td) is 400 to 1000 deg. C.

With an excessively low magnet material temperature, diffusion speed within the magnet material is low and efficient diffusion treatment cannot be performed. With an excessively high magnet material temperature, crystal grains are coarsened, which causes a decrease in magnetic properties. With an excessively low diffusing material temperature, the amount of vapor of the diffusing element is excessively small and efficient diffusion treatment cannot be performed. With an excessively high diffusing material temperature, the amount of vapor of the diffusing element is excessively large and an excess of the diffusing element may be deposited or concentrated on a surface of the magnet material, so coercivity improvement rate relative to the amount of the scarce diffusing element used decreases.

By the way, in order to perform effective diffusion treatment in a short time while suppressing the amount of the scarce diffusing element used, it is preferred that the magnet material temperature and the diffusing material temperature have an appropriate temperature difference. As a result of earnest study, the present inventors have found that when the magnet material and the diffusing material have the aforementioned compositions, it is preferred that the magnet material temperature is higher than the diffusing material temperature and the magnet material temperature and the diffusing material temperature have a temperature difference ($\Delta T = Tm - Td$) of 5 to 400 deg. C. or 5 to 250 deg. C. On the basis of this finding, it is preferred that the diffusing step of the present invention is a temperature control step of controlling a temperature difference between the magnet material temperature (Tm) and the diffusing material temperature (Td).

(4) By the way, the amount of vapor of the diffusing element is influenced not only by the diffusing material temperature but also by gas pressure or degree of vacuum around the diffusing material. For example, if the gas pressure is lowered (or the degree of vacuum is increased), the amount of vapor of the diffusing element can be increased. To put it the other way around, if the gas pressure is increased (or the degree of vacuum is lowered), the amount of vapor of the diffusing element can be decreased. Therefore, the amount of vapor of the diffusing element can be controlled not only by adjusting the aforementioned diffusing material temperature but also by adjusting pressure of gas such as inert gas (or the degree of vacuum) around the diffusing material. Prom this point of view, the diffusing step may include a gas pressure control step of controlling pressure of an atmospheric gas (including the degree of vacuum) surrounding the magnet material and the diffusing material.

It should be noted that when a diffusing rare earth element (Bd) is diffused into a magnet material comprising a Rm-Tm-B based rare earth magnet alloy as mentioned above, it is preferred that gas pressure (degree of vacuum) in a treatment furnace is not more than 1 Pa, not more than $10^{-1}$ Pa, not more than $10^{-2}$ Pa, or not more than $10^{-3}$ Pa.

Thus, according to the diffusing step of the present invention, the diffusing element can be sufficiently diffused into an inside of the magnet material in a treatment time of about 0.5 to 20 hours or 1 to 10 hours.

Magnet Material

The magnet material comprises a compact or a sintered body of powder particles comprising a rare earth magnet alloy. The powder particles will be discussed in detail here.

(1) Composition

The powder particles comprises a rare earth magnet alloy (hereinafter simply referred to as a "magnet alloy") comprising Rm which is at least one of rare earth elements, B and the remainder being transitional metal (TM: mainly Fe) and inevitable impurities with or without a reforming element.

It is preferred that the magnet alloy has a composition which allows formation of Rm-rich phase which is effective in improving coercivity and sintering ability of the magnet material when compared to a theoretical composition based on $Rm_2TM_{14}B$. Specifically speaking, it is preferred that the magnet alloy is a Rm-TM-B based alloy comprising 10 to 30 atomic % of Rm, 1 to 20 atomic % of B, and the remainder being TM relative to the total number of atoms of the magnet alloy.

An excessively small or large amount of any of the elements affects volume ratio of the $Rm_2Fe_{14}B_1$phase (2-14-1 phase) as a main phase, which results in deterioration of magnetic properties (residual magnetic flux density) and lowering of sintering ability. A lower limit value or an upper limit value of Rm or 8 can be arbitrarily selected and set within the above ranges. However, especially in a case of obtaining a sintered rare earth magnet, when Rm is 12 to 16 atomic % and B is 5 to 12 atomic %, a highly dense rare earth magnet having good magnetic properties can be easily obtained. Moreover, TM is basically a main component of the remainder, but if it has to be said, it is preferred that TM is 72 to 83 atomic %. However, content of TM being the remainder other than Rm and B can vary with content of a reforming element and inevitable impurities. It should, be noted that carbon (c) can be used in place of B, and in this case it is preferred to adjust the sum of B and C to 5 to 12 atomic %.

The powder particles are not limited in production method or form. The magnet particles can be what is obtained by applying mechanical pulverization or hydrogen decrepitation to a cast magnet alloy of a desired composition. Moreover, the magnet powder can be cast pieces having a thin plate shape obtained by rapidly solidifying a magnet alloy by strip casting or the like, what is produced by way of hydrogen treatment such as HDDR (Hydrogenation-Disproportionation/Desorption-Recombination method), ultrarapidly cooled ribbon particles, or films formed by sputtering or the like. Moreover, the powder particles can be amorphous.

Although the powder particles are not limited in particle diameter, either, it is preferred that mean particle diameter (particle diameter at a cumulative mass of 50 % or Median diameter) is about 1 to 20 μm or about 3 to 10 μm. An excessively small mean particle diameter causes an increase in costs, while an excessively large mean particle diameter may cause a decrease in density and magnetic properties of a rare earth magnet, though dispersion performance of the diffusing element into an inside is good. It should be noted that powder particles can be a mixture of plural kinds of powders which are different in composition or form (e.g., particle shape and particle diameter).

Use Application of Rare Earth Magnet

The rare earth magnet of the present invention can be a raw material, a final product or one close to the final product. Use application and form of the rare earth magnet are not limited. The rare earth magnet of the present invention can be used, for example, in a variety of electromagnetic devices such as rotors and stators of electric motors, magnetic recording media such as magnetic disks, linear actuators, linear motors, servo motors, speakers, electric generators and so on.

EXAMPLES

The present invention will be described more specifically by way of examples.

Diffusion Treatment Device

A schematic view of a diffusion treatment device (a device for producing a rare earth magnet) 1 which can be used in diffusion treatment of the present invention is shown in FIG. 1. The diffusion treatment device 1 comprises a treatment chamber 10, a preparatory chamber 20 communicating with this treatment chamber 10, an open and shut gate (stopping means) 30 capable of freely switching on and off of communication between these two chambers, a pedestal (placing means) disposed in the treatment chamber 10 and holding a magnet material M, an elevator (transferring means) for transferring a diffusing material D between the treatment chamber 10 and the preparatory chamber 20, a flat heater (diffusing material heating means) 22 for heating the diffusing material D attached to the elevator 21, a vapor pack 13 which is an enclosure surrounding the magnet material M and the diffusing material D placed in a vicinity of each other so as to efficiently expose the magnet material M to a vapor atmosphere generating from the diffusing material D.

Although not shown, the diffusion treatment device 1 further comprises a vacuum pump (gas pressure control means) for adjusting the degree of vacuum in the treatment chamber 10, magnet material heating means for heating the magnet material M (which can be heating means in the treatment chamber 10), and control means for totally controlling magnet material temperature, diffusing material temperature, the degree of vacuum in the treatment chamber 10, up and down of the elevator 21 and so on.

Example 1

Preparation of Specimens

Respective specimens (anisotropic sintered rare earth magnets) subjected to diffusion treatment were produced by using this diffusion treatment device 1. Hereinafter, this diffusion treatment will be described in detail.

(1) Magnet Material

A magnet material (sintered bodies) to be subjected to diffusion treatment was produced as follows. First, an Fe-31.5% Nd-1% B-1% Co-0.2% Cu (unit: % by mass) magnet alloy was cast. This magnet alloy was subjected to hydrogen decrepitation and then further pulverized by a jet mill, thereby obtaining magnet powder having a mean particle diameter D50 (Median diameter) of 6 μm. The pulverization by the jet mill was performed in a nitrogen atmosphere.

This magnet powder was charged in a cavity of a forming mold and molded in a magnetic field, thereby obtaining compacts in a rectangular parallelepiped shape with dimensions 20×15×10 mm (a forming step). The applied magnet field was 2T, The thus obtained formed bodies were heated in a vacuum atmosphere of up to $10^{-3}$ Pa at 1,050 deg. C. for 4 hours, thereby obtaining sintered bodies (a sintering step). A magnet material obtained by polishing surfaces of the sintered bodies was subjected to the following diffusion treatment.

(2) Diffusion Treatment

Simple substance Dy (metal Dy) was prepared as a diffusing material serving as a source of vapor of a diffusing element. Diffusion treatment by a vapor method described below was applied to the aforementioned magnet material by using this diffusing material.

First, the magnet material was placed in the treatment chamber 10 of the diffusion treatment device 1, and heated to respective magnet material temperatures (Tm) shown in Table 1. In parallel with this heating, the diffusing material placed in the preparatory chamber 20 was heated to respective diffusing material temperatures (Td) shown in Table 1. It should be noted that these heating treatments were respectively performed in a vacuum atmosphere of $10^{-4}$ Pa.

When the magnet material reached a predetermined temperature (Tm), the gate 30 was opened and the diffusing material in the preparatory chamber 20 was transferred to the treatment chamber 10 and placed in a vicinity of the magnet material (a placing step). At this time, the magnet material and the diffusing material have a distance of about 10 mm. In this case, both atmospheres in the treatment chamber 10 and the preparatory chamber 20 were controlled to $10^{-4}$ Pa, Then the magnet material and the diffusing material were respectively heated for two hours at the magnet material temperature (Tm) and the diffusing material temperature (Td) shown in Table 1 (a diffusing step), and then the diffusing material was transferred to the preparatory chamber 20 and the gate 30 was closed.

(3) As comparative examples, specimens were produced by placing the magnet material and the diffusing material in the same treatment chamber 10 from the beginning and heating these two materials at the same temperatures. In this case, an atmosphere in the treatment chamber 10 was also a vacuum atmosphere of $10^{-4}$ Pa, but heating time was 128 hours. The reason why the heating time was increased in the comparative examples when compared to the examples is that diffusion hardly proceeded in a short time of about 2 hours and the amount of diffusion (ΔRd, ΔDy) was almost zero.

Measurement of Specimens

For the respective obtained specimens, coercivity was measured by using a pulsed high field magnetometer. Also the amount of Dy diffused into the respective specimens was measured by an electron probe microanalyzer (EPMA) and by high frequency inductively-coupled plasma mass spectrometer (ICP). The measurement results thus obtained are shown together in Table 1. Furthermore, a difference in coercivity of each of the specimens between before and after the diffusion treatment (ΔHcJ: kOe) was divided by the amount of the diffusing element diffused into each of the specimens (ΔRd, (ΔDy in these examples):mass %), thereby obtaining a coercivity improvement rate. The coercivity improvement rate was further divided by diffusion treatment time (t: time), thereby calculating a diffusion efficiency ((ΔHcJ/ΔDy)/t: (kOe/mass %)/time), The calculated diffusion efficiency is also shown in Table 1. Moreover, FIG. 2 shows a relation between a temperature difference between the magnet material temperature (Tm) and the diffusing material temperature (Td) (ΔT=Tm−Td) and the amount of Dy diffused per unit time.

Evaluation of Specimens

Figure 2:
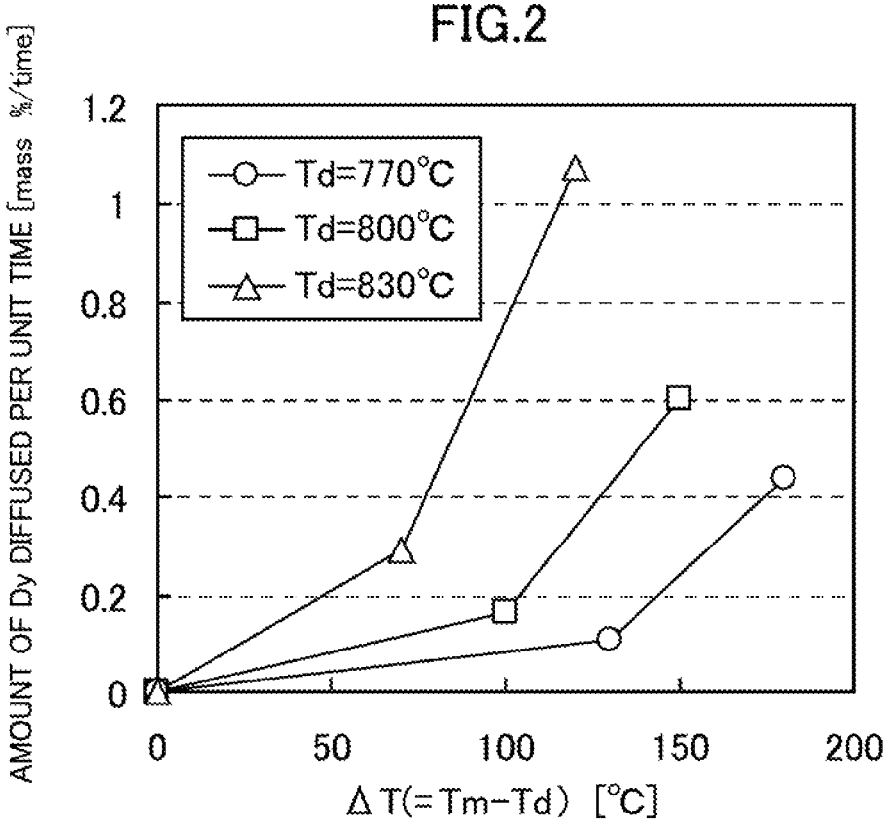
FIG. 2 is a graph showing a relation of a temperature difference between magnet material temperature and diffusing material temperature, and the amount of diffusion per unit time.

It is apparent from the results shown in Table 1 and FIG. 2 that even heating in a short time can sufficiently diffuse the diffusing element (Dy) into an inside of the magnet by performing diffusion treatment by selecting appropriate magnet material temperature (Tm) and diffusing material temperature (Td), Moreover, when the diffusion treatment of the present invention is compared with conventional diffusion treatment in which the magnet material and the diffusing material were heated at the same temperature in the same treatment chamber 10, the aforementioned diffusion efficiency improved on a quite different scale (10 to 1000 times), and it is apparent that coercivity can be improved efficiently in a short time while suppressing the amount of scarce Dy.

TABLE 1

| | DIFFUSION TRESTMENT CONDISION | | | THE AMOUNT OF | | |
|---|---|---|---|---|---|---|
| SPECIMEN NO. | MAGNET MATERIAL TEMP. Tm (deg. C.) | DIFFUSING MATERIAL TEMP. Td (deg. C.) | TEMP. DIFFERENCE ΔT = Tm − Td (deg. C.) | DIFFUSING ELEMENT PER UNIT TIME ΔDy (mass %/TIME) | COERCIVITY HcJ (kOe) | DIFFUSION EFFICIENCY (ΔHcJ/ΔDy)/t (kOe/(mass % × TIME)) |
| 1 | 1000 | 770 | 230 | 0.465 | 18.5 | 3.180 |
| 2 | 1000 | 830 | 170 | 1.887 | 19.3 | 0.880 |
| 3 | 950 | 830 | 120 | 1.075 | 19.5 | 1.60 |
| 4 | 950 | 800 | 150 | 0.599 | 18.7 | 2.53 |
| 5 | 950 | 770 | 180 | 0.436 | 18.2 | 3.22 |
| 6 | 900 | 830 | 70 | 0.291 | 18.0 | 4.63 |
| 7 | 900 | 800 | 100 | 0.163 | 17.2 | 7.01 |
| 8 | 900 | 770 | 130 | 0.108 | 16.4 | 8.77 |
| 9 | 850 | 830 | 20 | 0.070 | 15.5 | 10.51 |
| 10 | 850 | 800 | 50 | 0.048 | 15.3 | 13.78 |
| 11 | 850 | 770 | 80 | 0.029 | 14.5 | 16.84 |
| C1 | 870 | | 0 | 0.0128 | 18.3 | 0.05 |
| C2 | 840 | | | 0.0027 | 16.6 | 0.18 |
| C3 | 810 | | | 0.0009 | 15.2 | 0.35 |
| C4 | 780 | | | 0.0004 | 13.8 | 0.57 |

REFERENCE SIGNS LIST

1 Diffusion treatment device (device for producing a rare earth magnet)
10 Treatment chamber
20 Preparatory chamber
M Magnet material
D Diffusing material

The invention claimed is:

1. A method for producing a rare earth magnet, comprising:

a placing step of placing a magnet material including a compact or a sintered body of powder particles having a rare earth magnet alloy, and a diffusing material containing a diffusing element to improve coercivity, in a vicinity of each other; and a diffusing step of diffusing the diffusing element into an inside of the magnet material by exposing the magnet material to vapor of the diffusing element evaporated from the diffusing material;

wherein:

the diffusing step includes heating the diffusing material independently of the magnet material;

the magnet material is heated to a magnet material temperature (Tm) that is higher than a diffusing material temperature (Td) to which the diffusing material is heated;

a temperature difference between the magnet material temperature and the diffusion material temperature (ΔT=Tm−Td) is from 20 to 130 deg. C.;

the magnet material temperature is from 850 to 900 deg. C.; and the diffusing element is dysprosium.

2. The method for producing a rare earth magnet recited in claim 1, wherein:

the magnet material is the compact of the powder particles, and the diffusing step is performed during a sintering step of sintering the compact.

3. The method for producing a rare earth magnet recited in claim 2, wherein the diffusing step is performed during a temperature rising stage or a cooling stage of the sintering step.

4. The method for producing a rare earth magnet recited in claim 1, wherein:

the diffusing element is a diffusing rare earth element (hereinafter referred to as "Rd") which is at least one of rare earth elements; and the diffusing material temperature (Td) is 770 to 830 deg. C.

5. A method for producing a rare earth magnet, comprising:

a placing step of placing a magnet material including an unsintered compact of powder particles having a rare earth magnet alloy, and a diffusing material containing a diffusing element to improve coercivity, in a vicinity of each other; and a diffusing step of diffusing the diffusing element into an inside of the magnet material by exposing the magnet material to vapor of the diffusing element evaporated from the diffusing material;

wherein:

the diffusing step is performed during a temperature rising stage or a cooling stage of a sintering step of heating the unsintered compact to obtain a sintered body;

the magnet material is heated to a magnet material temperature (Tm) that is higher than a diffusing material temperature (Td) to which the diffusing material is heated;

a temperature difference between the magnet material temperature and the diffusion material temperature ($\Delta$=Tm−Td) is from 20 to 130 deg. C.;

the magnet material temperature is from 850 to 900 deg. C.; and the diffusing element is dysprosium.

6. The method for producing a rare earth magnet recited in claim 1, wherein the temperature difference between the magnet material temperature and the diffusion material temperature ($\Delta$T=Tm−Td) is from 50 to 130 deg. C.

* * * * *